US011640871B2

(12) United States Patent
Kawaguchi et al.

(10) Patent No.: US 11,640,871 B2
(45) Date of Patent: May 2, 2023

(54) TRANSFORMER AND POWER CONVERSION DEVICE

(71) Applicant: Mitsubishi Electric Corporation, Tokyo (JP)

(72) Inventors: Takayuki Kawaguchi, Tokyo (JP); Tomoki Watanabe, Tokyo (JP); Yumi Najima, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 316 days.

(21) Appl. No.: 16/758,625

(22) PCT Filed: Nov. 8, 2017

(86) PCT No.: PCT/JP2017/040207
§ 371 (c)(1),
(2) Date: Apr. 23, 2020

(87) PCT Pub. No.: WO2019/092800
PCT Pub. Date: May 16, 2019

(65) Prior Publication Data

US 2020/0350116 A1 Nov. 5, 2020

(51) Int. Cl.
*H01F 27/29* (2006.01)
*H01F 27/24* (2006.01)
*H01F 27/28* (2006.01)

(52) U.S. Cl.
CPC ..... *H01F 27/29* (2013.01); *H01F 27/24* (2013.01); *H01F 27/2876* (2013.01)

(58) Field of Classification Search
CPC ..... H01F 27/29; H01F 27/24; H01F 27/2876
See application file for complete search history.

(56) References Cited

U.S. PATENT DOCUMENTS 6,185,811 B1 2/2001 Perry
6,633,480 B1 * 10/2003 Herzog ..... B29C 66/836 361/676

(Continued)

FOREIGN PATENT DOCUMENTS

CN 205900267 U 1/2017
DE 112016006459 T5 10/2018

(Continued)

OTHER PUBLICATIONS

Office Action (Notification of Reasons for Rejection) dated May 26, 2020, by the Japan Patent Office in corresponding Japanese Patent Application No. 2019-551800 and English translation of the Office Action. (9 pages).

(Continued)

*Primary Examiner* — Michael P McFadden
(74) *Attorney, Agent, or Firm* — Buchanan Ingersoll & Rooney PC

(57) ABSTRACT

A transformer includes: a base that is a plate-like member and has a first surface and a second surface, a core attached to the first surface of the base, coils wound around the core, coil terminals attached to the second surface of the base, and a cooling unit that is thermally connected to the core and is to release heat transferred from the core. The coil terminals are disposed on the second surface of the base opposite to the first surface of the base to which the core is attached. The cooling unit is disposed on a side of the core opposite to the base.

16 Claims, 7 Drawing Sheets

(56) References Cited

U.S. PATENT DOCUMENTS

| | | | | |
|---|---|---|---|---|
| 2001/0033216 | A1* | 10/2001 | Shirahata | H01F 30/12 336/5 |
| 2003/0168232 | A1* | 9/2003 | Wiebe | H01F 27/04 174/50 |
| 2003/0197583 | A1* | 10/2003 | Choi | H05B 6/662 336/58 |
| 2004/0183385 | A1* | 9/2004 | Takahashi | H02K 9/06 310/58 |
| 2005/0243502 | A1* | 11/2005 | Griesinger | H01F 27/10 165/138 |
| 2006/0012948 | A1* | 1/2006 | Norris | H01F 27/02 361/603 |
| 2007/0247266 | A1 | 10/2007 | Yargole et al. | |
| 2009/0261933 | A1* | 10/2009 | Kiuchi | H01F 27/12 336/57 |
| 2012/0013427 | A1 | 1/2012 | Noda et al. | |
| 2019/0020279 | A1 | 1/2019 | Kitanaka et al. | |

FOREIGN PATENT DOCUMENTS

| | | | |
|---|---|---|---|
| JP | 559-109109 | U | 7/1984 |
| JP | H01100415 | U | 7/1989 |
| JP | H0217814 | U | 2/1990 |
| JP | H03-124007 | A | 5/1991 |
| JP | H069116 | U | 2/1994 |
| JP | H08102423 | A | 4/1996 |
| JP | 2000091130 | A | 3/2000 |
| JP | 2001-144232 | A | 5/2001 |
| JP | 2008072033 | A | 3/2008 |
| JP | 2008-510297 | A | 4/2008 |
| JP | 2010-130779 | A | 6/2010 |
| JP | 2011181856 | A | 9/2011 |
| JP | 2011-211773 | A | 10/2011 |
| JP | 2012138439 | A | 7/2012 |
| JP | 2013-198387 | A | 9/2013 |
| JP | 2014011390 | A | 1/2014 |
| JP | 2014079129 | A | 5/2014 |
| WO | 2010/150345 | A1 | 12/2010 |
| WO | 2015/025392 | A1 | 2/2015 |
| WO | 2015170566 | A1 | 11/2015 |

OTHER PUBLICATIONS

Office Action dated Dec. 14, 2020, by the India Patent Office in corresponding India Patent Application No. 202027013385 and English translation of the Office Action. (6 pages).

International Search Report (with English Translation) and Written Opinion issued in corresponding International Patent Application No. PCT/JP2017/040207, 11 pages (Feb. 13, 2018).

Office Action dated Sep. 16, 2022, issued for the corresponding DE patent application No. 112017008067.3, 12 pages including 6 pages of English Translation.

Office Action issued in corresponding Chinese Application No. 201780096434.8, dated Dec. 5, 2022, 18 pages including 10 pages of Partial English Translation.

* cited by examiner

TRANSFORMER AND POWER CONVERSION DEVICE

TECHNICAL FIELD

The present disclosure relates to a transformer and a power conversion device including the transformer.

BACKGROUND ART

An electric railway vehicle is equipped with a power conversion device that converts input DC power or input AC power into desired power and outputs the converted power. For example, an auxiliary power supply device converts power input from an overhead wire and outputs desired power suitable for a load device such as an air conditioner or a lighting device. The power conversion device includes, for example, a transformer disclosed in Patent Literature 1.

CITATION LIST

Patent Literature

Patent Literature 1: Unexamined Japanese Patent Application Kokai Publication No. H08-102423

SUMMARY OF INVENTION

Technical Problem

When the power conversion device performs power conversion, the transformer generates heat. The power conversion device mounted on the electric railway vehicle has a larger capacity than power conversion devices for general industrial use and has a large amount of heat generated by the transformer. Therefore, in order to cool the transformer, for example, the transformer is exposed to ambient air, the power conversion device is provided with a blower to blow air to the transformer. In a case in which cooling of the transformer is insufficient even if the transformer is cooled as described above, cooling capacity is to be enhanced, for example, by using a blower with higher cooling capacity. Alternatively, loss in the transformer is to be reduced and heat generation due to the transformer is to be suppressed by enlarging the core or increasing the number of turns of a coil. As described above, although the cooling capacity of the transformer can be improved and the heat generation can be suppressed, the power conversion device has a further problem in that volumes and weights of the transformer and the blower increase.

In order to solve the aforementioned problem, an objective of the present disclosure is to improve cooling capacity while suppressing an increase in the size of a transformer.

Solution to Problem

In order to achieve the aforementioned objective, a transformer according to the present disclosure includes a base that is a plate-like member and has a first surface and a second surface, a core, coils, coil terminals, and a cooling unit. The core is attached to the first surface of the base. The coils are wound around the core. The coil terminals are each electrically connected to one end of a corresponding coil of the coils, and are disposed on the second surface opposite to the first surface to which the core is attached. The cooling unit is disposed on a side of the core opposite to the base, is thermally connected to the core, and is to release heat transferred from the core.

Advantageous Effects of Invention

According to the present disclosure, the transformer is provided with the cooling unit that is thermally connected to the core and releases heat transferred from the core, thereby enabling improvement of the cooling capacity while suppressing the increase in the size of the transformer.

DESCRIPTION OF EMBODIMENTS

An embodiment of the present disclosure is described below in detail with reference to the drawings. Components that are the same or equivalent are assigned the same reference signs throughout the drawings.

Figure 1:
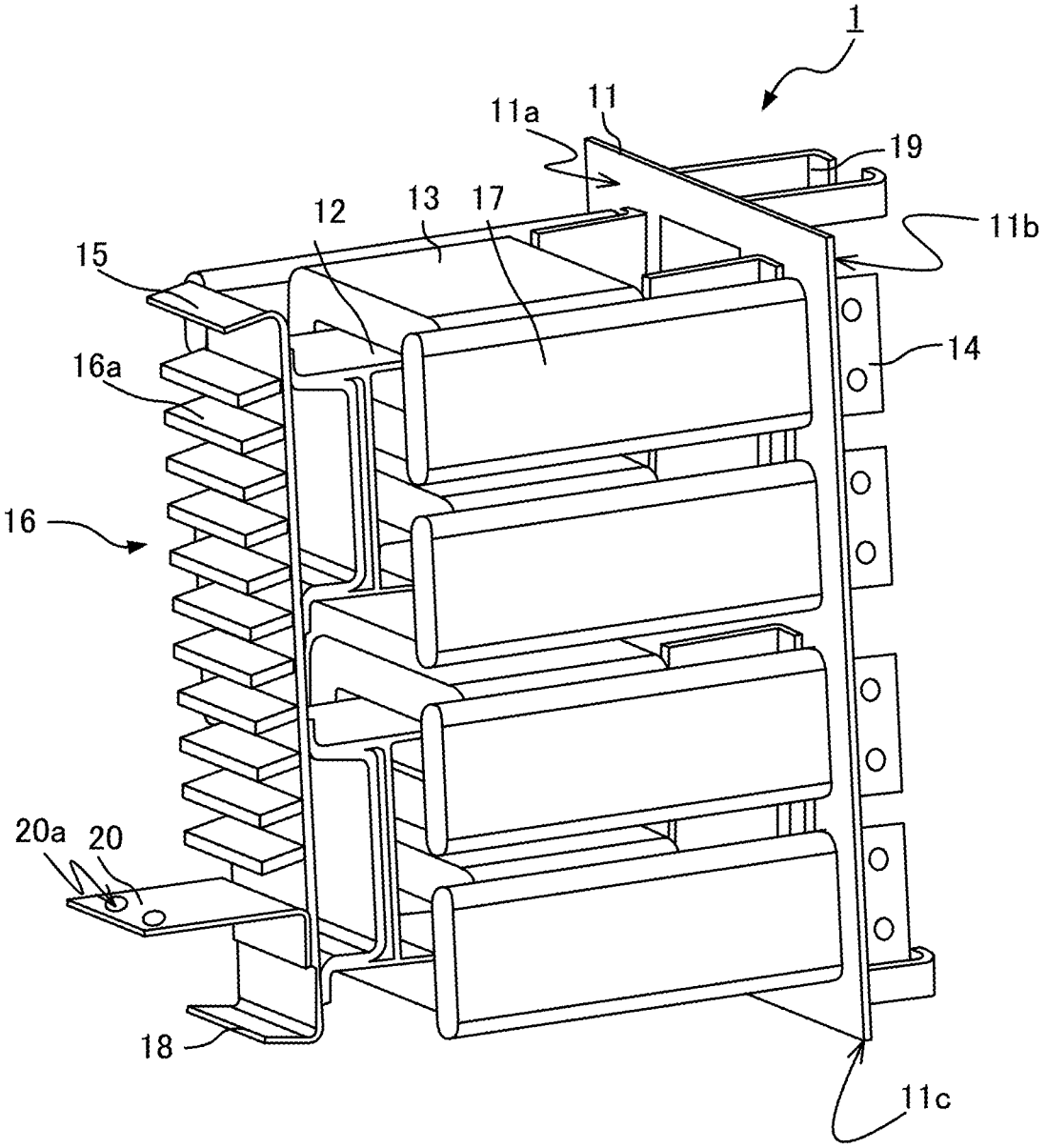
FIG. 1 is a perspective view illustrating a transformer according to an embodiment of the present disclosure.
Figure 2:
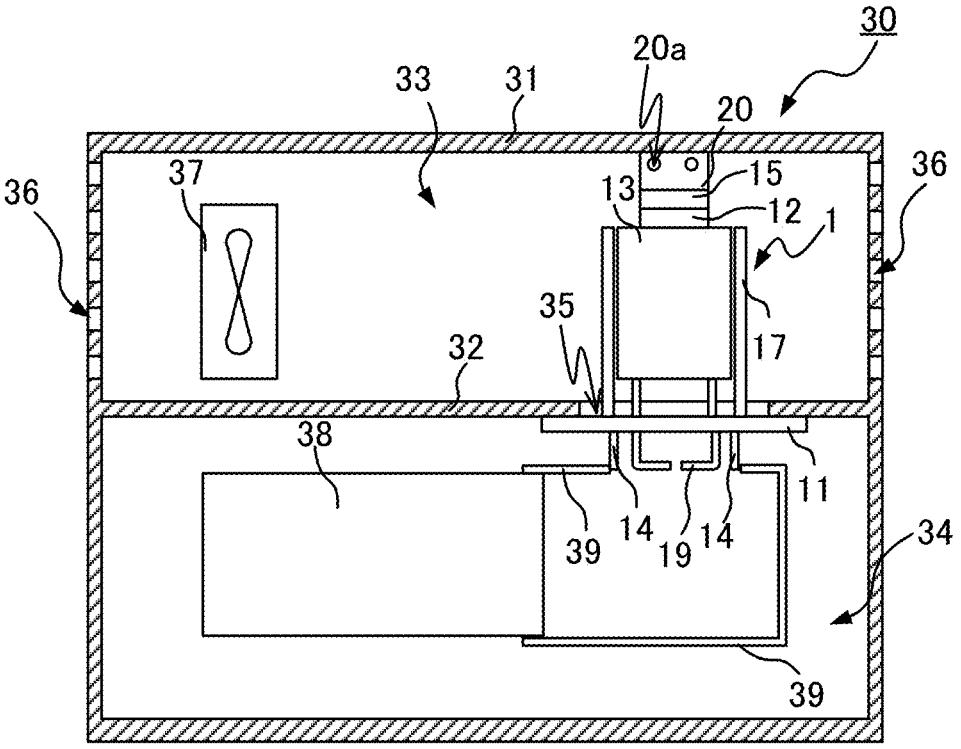
FIG. 2 is a cross-sectional view illustrating a power conversion device according to the embodiment.

FIG. 1 is a perspective view illustrating a transformer according to an embodiment of the present disclosure. FIG. 2 is a cross-sectional view illustrating a power conversion device according to the embodiment. A power conversion device 30 including a transformer 1 is mounted on an electric railway vehicle. FIG. 2 is a view illustrating the power conversion device 30 as viewed from above in the vertical direction. The power conversion device 30 is mounted under a floor of the electric railway vehicle, for example, by a hanging clasp that is not illustrated in the drawings.

The transformer 1 includes a base 11 that is a plate-like member, a core 12 attached to a first surface 11*a* of the base 11, coils 13 wound around the core 12, coil terminals 14 attached to a second surface 11*b* of the base 11, and a cooling unit 16 that is thermally connected to the core 12 and releases heat transferred from the core 12. The first surface 11*a* of the base 11 extends in the vertical direction. In the example of FIG. 1, the first surface 11*a* of the base 11 is parallel to the vertical direction, and the core 12 included in the transformer 1 is a plurality of cores. The coils 13 are wound around the cores 12. In the example of FIG. 1, the coils 13 are wound around the cores 12 in such a manner that a central axis of each of the coils 13 extends in a direction orthogonal to the first surface 11*a* of the base 11. The coil terminals 14 are each electrically connected to one end of the corresponding coil 13 of the coils 13. The coil terminals 14 are disposed on the second surface 11*b* of the base 11 opposite to the first surface 11*a* to which the core 12 is attached. One ends of the coils 13 pass through the interior of an insulating member 17 and the base 11 and are connected to the coil terminals 14 disposed on the second surface 11*b*. The cooling unit 16 is disposed on a side of the core 12 opposite to the base 11.

In the example of FIG. 1, the transformer 1 includes the cores 12 and further includes a fixing frame 15 to which the cores 12 are fixed. The fixing frame 15 has a thermal conductivity for transferring heat generated by the core 12 to the cooling unit 16 and is made of a material having a strength required for fixing the core 12, for example, stainless steel. The cooling unit 16 has a fin-like shape and releases heat transferred from the core 12 via the fixing frame 15. In the example of FIG. 1, the cooling unit 16 has fins 16*a* extending in the horizontal direction. The fins 16*a* are attached to the fixing frame 15 at intervals in the vertical direction. The cooling unit 16 is made of a material such as aluminum in accordance with cooling capacity desired for the transformer 1.

The fixing frame 15 is a plate-like member extending in the vertical direction as illustrated in FIG. 1 and may have a slide portion 18 that (i) extends away from the base 11 at the vertically lower end of the fixing frame 15 and (ii) has an edge located at a position, in the vertical direction, higher than a position of the vertically lower end of the fixing frame 15. The slide portion 18 forms a slide surface of a vertically lower portion of the transformer 1, thereby facilitating easy movement of the transformer 1 in the horizontal direction by pushing a handle 19. In addition to the slide portion 18, a third surface 11*c* that is a surface on the vertically lower side and orthogonal to the first surface 11*a* and the second surface 11*b* of the base 11 may also form a slide surface of the vertically lower portion of the transformer 1. Additionally, as in the example of FIG. 1, the fixing frame 15 may be provided with a locking member 20. The locking member 20 has locking holes 20*a*. For example, movement of the transformer 1 inside the power conversion device 30 is suppressed by the locking member 20 engaging protrusions of the power conversion device 30 (not illustrated in the drawings) via the locking holes 20*a*.

The power conversion device 30 includes a housing 31 accommodating the transformer 1 and an electronic circuit 38 illustrated in FIG. 1. The housing 31 is divided by a partition 32 into (i) an open section 33 through which an ambient air flow passes and (ii) a closed section 34 through which an ambient air flow does not pass. The partition 32 has an opening 35. Vents 36 are formed on surfaces of the housing 31 facing the open section 33. A blower 37 is disposed in the open section 33. Operation of the blower 37 causes air flowing in from the vent 36 to come into contact with the cooling unit 16, and the cooling unit 16 releases, into the air, heat transferred from the core 12. The blower 37 may be omitted and the transformer 1 may be naturally cooled by a wind caused by movement of the railway vehicle on which the power conversion device 30 is mounted. The orientations of the fins 16*a* may be determined in accordance with the flow of air in the open section 33. The electronic circuit 38 is accommodated in the closed section 34. The electronic circuit 38 is electrically connected to the coil terminals 14 by a conductor 39 that is, for example a copper bar. The electronic circuit 38 is, for example, a filter circuit disposed on the primary side of the transformer 1, an inverter circuit disposed on the secondary side of the transformer 1, or the like.

The transformer 1 is accommodated in the housing 31 such that (i) the core 12, the coil 13, and the cooling unit 16 are disposed in the open section 33 and (ii) the coil terminals 14 are disposed in the closed section 34, and the base 11 of the transformer 1 covers the opening 35 formed in the partition 32. By accommodating the transformer 1 as described above, the core 12 requiring cooling is located in the open section 33, and the coil terminals 14 requiring insulation protection are located in the closed section 34. The transformer 1 is inserted into the interior of power conversion device 30 from an inspection port formed in the housing 31 and not illustrated in the drawings. As described above, forming of the slide surface by the slide portion 18 facilitates easy pushing of the transformer 1 into the interior of the power conversion device 30 and improves the maintainability of the power conversion device 30. As described above, since the position of one end of the slide portion 18 in the vertical direction is higher than the position of the vertically lower end of the fixing frame 15, when the transformer 1 is pushed into the interior of the power conversion device 30, the transformer 1 is inhibited from getting caught on the bottom surface of the housing 31. For example, the transformer 1 is inserted into the interior of the power conversion device 30 from the inspection opening that is formed in the housing 31 located on the lower side in FIG. 2, and the first surface 11*a* of the base 11 is pushed until the first surface 11*a* abuts the partition 32.

Figure 3:
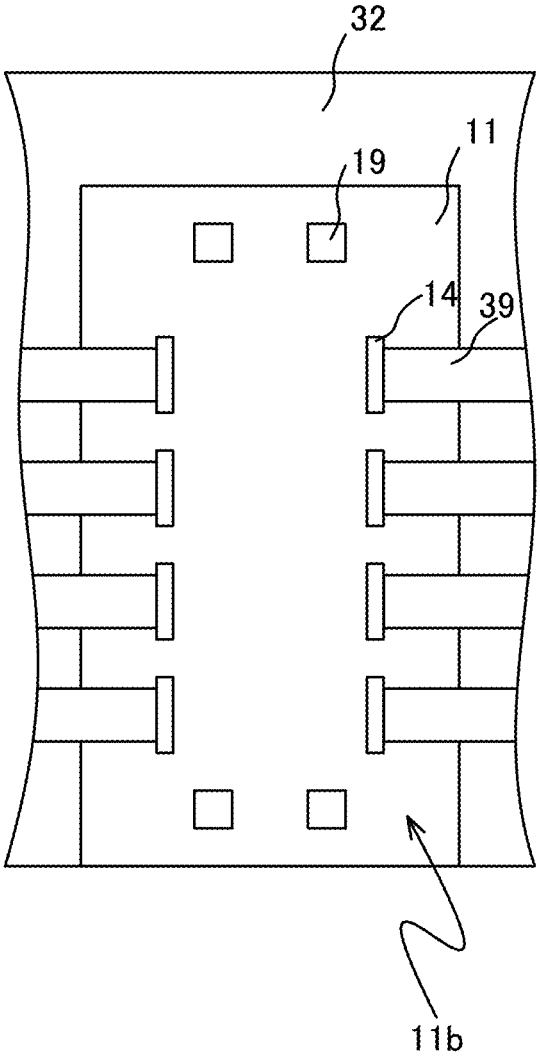
FIG. 3 is a drawing of the transformer according to the embodiment as viewed from a closed section.

FIG. 3 is a drawing of the transformer according to the embodiment as viewed from the closed section. The base 11 of the transformer 1 covers the opening 35, thereby separating the open section 33 and the closed section 34 from each other. That is, an additional member is not needed for separating the open section 33 and the closed section 34 from each other. Additionally, a member is not needed for blocking the entry of dust, water or the like in the open section 33 into the closed section 34, such as a cable gland. Therefore, reductions in size and weight of the power conversion device 30 and improvement of maintainability of the power conversion device 30 are possible. Any material can be used for making the base 11 as long as the open section 33 and the closed section 34 can be separated from each other. The base 1 may be made of metal material or non-metal material. Packings are attached to all the surfaces of the base 11 that are orthogonal to the first surface 11*a* and the second surface 11*b* and include the third surface 11*c*, thereby enabling improvement of enclosure performance of the closed section 34. Alternatively, a packing is attached around the opening 35, thereby enabling improvement of the enclosure performance of the closed section 34.

Figure 4:
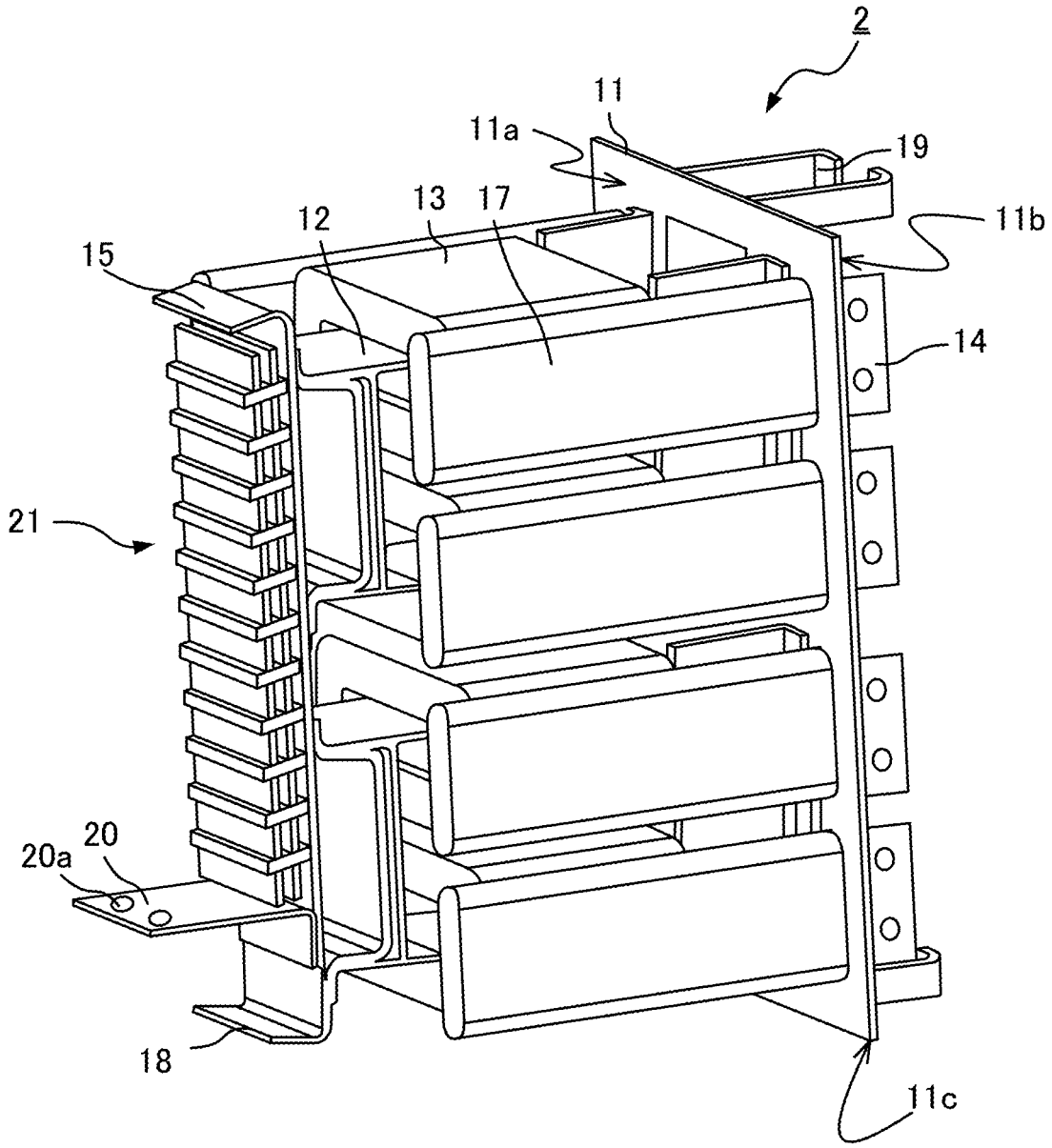
FIG. 4 is a perspective view illustrating a first modified example of the transformer according to the embodiment.

FIG. 4 is a perspective view illustrating a first modified example of the transformer according to the embodiment. A transformer 2 illustrated in FIG. 4 includes a cooling unit 21 instead of the cooling unit 16 of the transformer 1 illustrated in FIG. 1. The cooling unit 21 has a lattice-like shape. Since the surface area of the cooling unit 21 is larger than the surface area of the cooling unit 16 having a fin-like shape, the cooling capacity of the transformer 2 improves.

Figure 5:
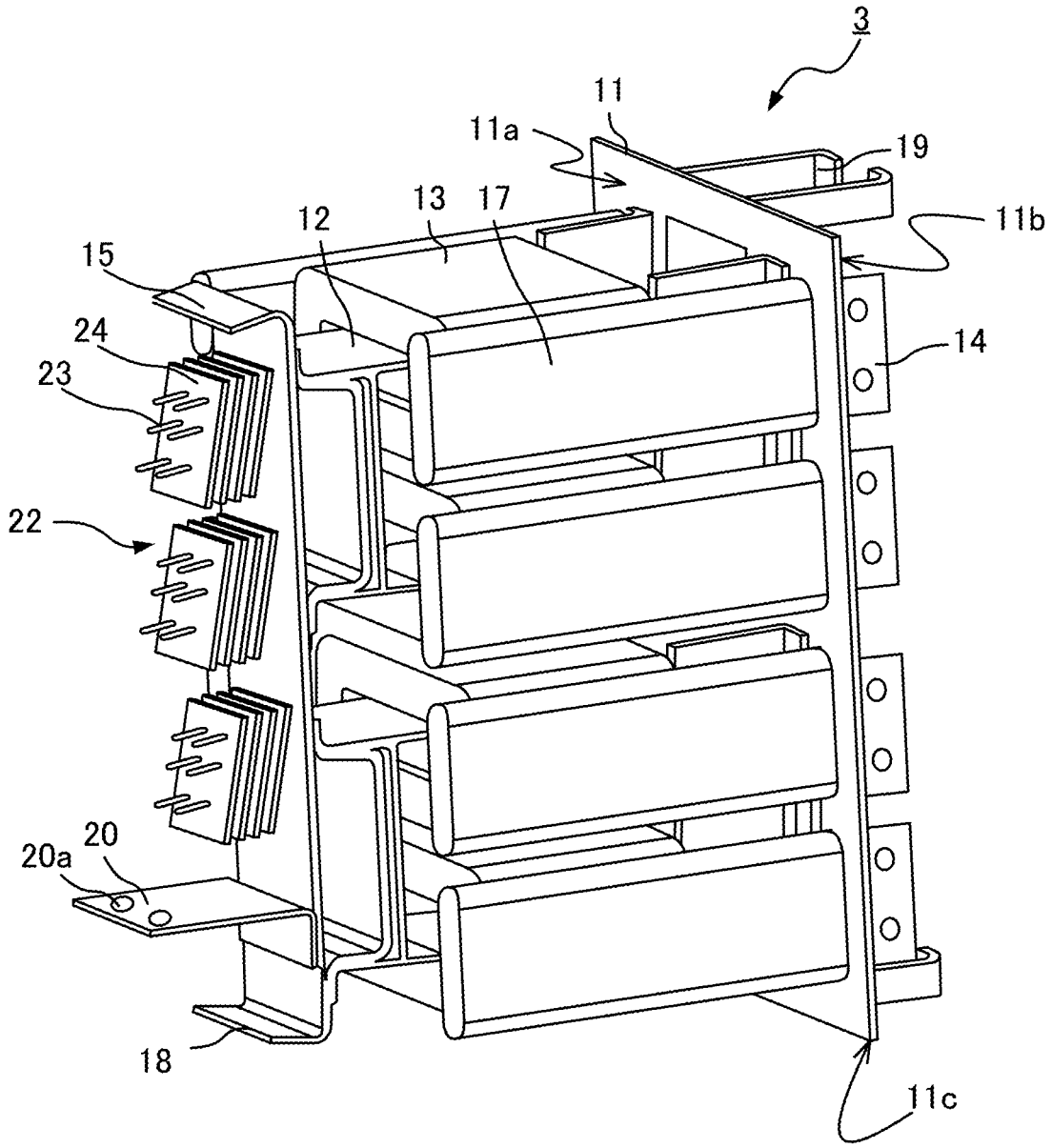
FIG. 5 is a perspective view illustrating a second modified example of the transformer according to the embodiment.

FIG. 5 is a perspective view illustrating a second modified example of the transformer according to the embodiment. A transformer 3 illustrated in FIG. 5 includes a cooling unit 22 instead of the cooling unit 16 of the transformer 1 illustrated in FIG. 1. The cooling unit 22 includes (i) heat pipes 23 in which refrigerant is enclosed and (ii) fins 24 each attached to the heat pipes 23.

Figure 6:
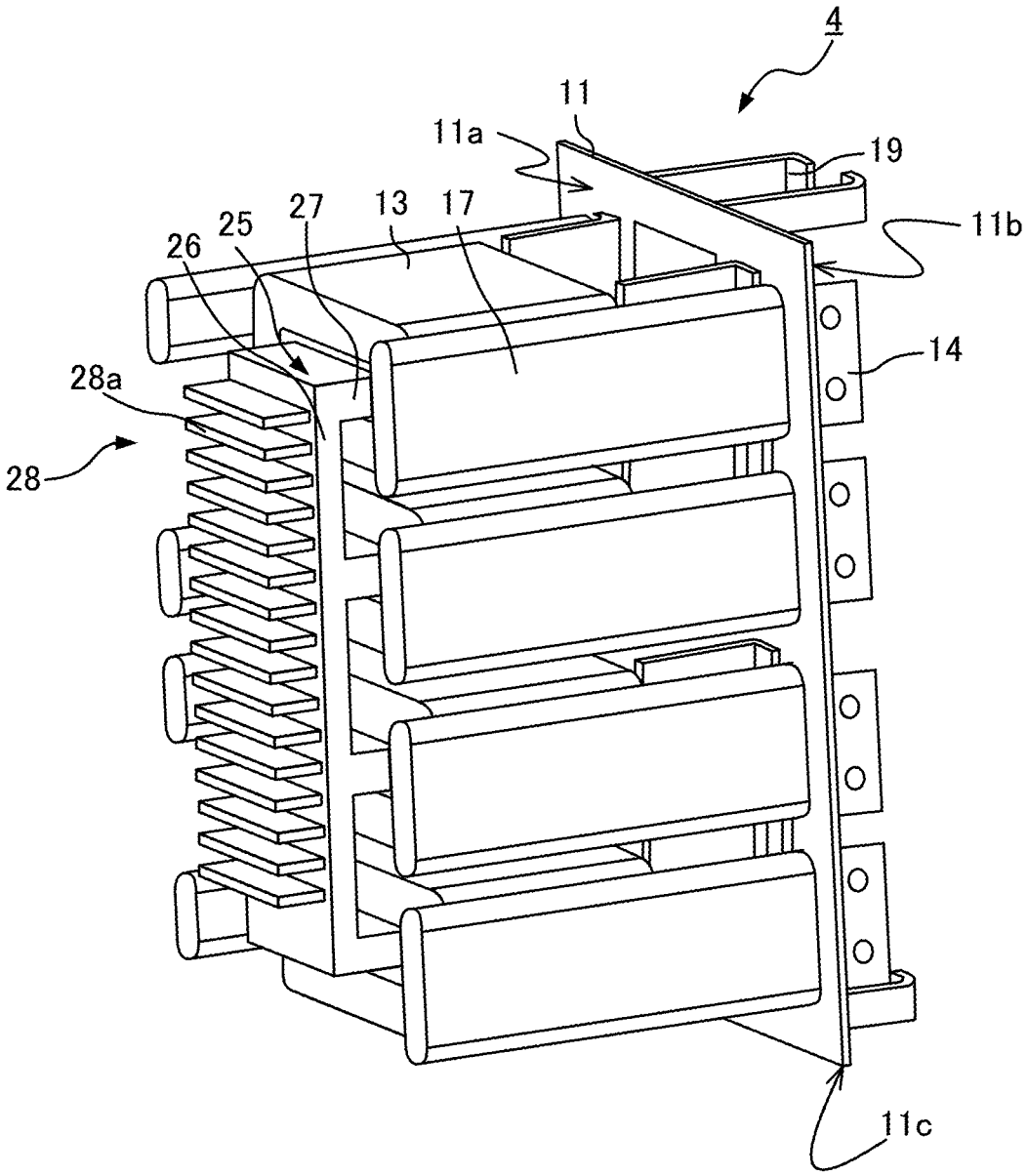
FIG. 6 is a perspective view illustrating a third modified example of the transformer according to the embodiment.

FIG. 6 is a perspective view illustrating a third modified example of the transformer according to the embodiment. A transformer 4 illustrated in FIG. 6 includes one core 25 instead of the cores 12 of the transformer 1 illustrated in FIG. 1. The core 25 has (i) a pair of end portions 26 extending in parallel with the first surface 11*a* of the base 11 and (ii) legs 27 connecting the pair of end portions 26. Additionally, the transformer 4 illustrated in FIG. 6 has a cooling unit 28 instead of the cooling unit 16 of the transformer 1 illustrated in FIG. 1. The cooling unit 28 is directly attached to the core 25 and releases heat transferred from the core 25. In the example of FIG. 6, the cooling unit 28 includes fins 28*a* extending in the horizontal direction. The fins 28*a* are attached to the core 25 at intervals in the vertical direction. The orientations of the fins 28*a* can be determined in accordance with the flow of air in the open section 33. The shape of the cooling unit 28 is not limited to the fin-like shape and may be a lattice-like shape like the cooling unit 21 of the transformer 2 illustrated in FIG. 4. Alternatively, the cooling unit 28 may include the heat pipes 23 and fins 24 like the cooling unit 22 illustrated in FIG. 5.

As described above, the transformers 1, 2 and 3 according to the embodiment respectively include the cooling units 16, 21 and 22 each of which is thermally connected to the core 12 and releases heat transferred from the core 12 via the fixing frame 15, thereby enabling improvement of the cooling capacity while suppressing an increase in the sizes of the transformers 1, 2 and 3. Additionally, the transformer 4 according to the embodiment includes the cooling unit 28 that is directly connected to one core 25 and releases heat transferred from the core 25, thereby enabling improvement of the cooling capacity while suppressing an increase in the size of the transformer 4.

Figure 7:
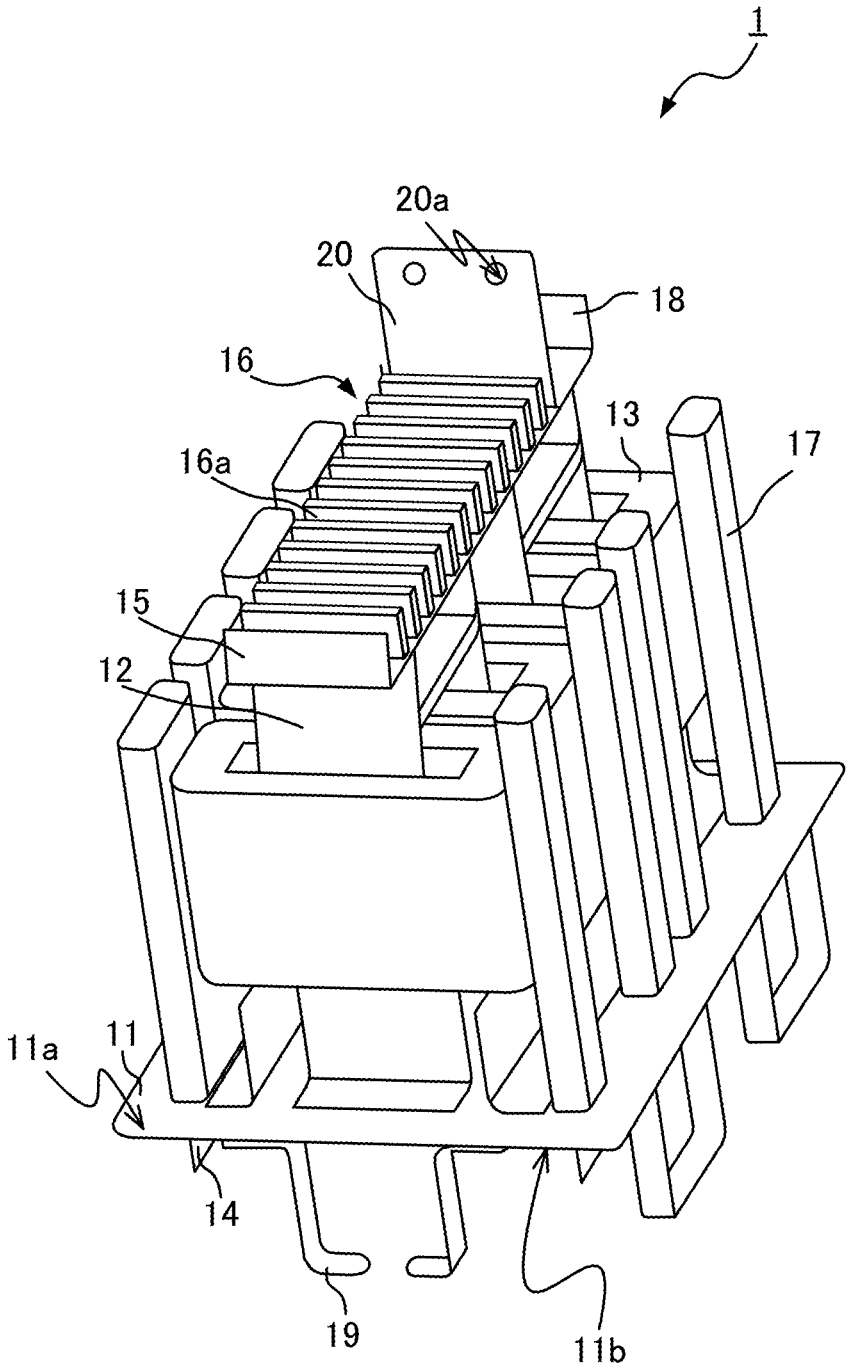
FIG. 7 is a drawing illustrating another example of a placement of the transformer according to the embodiment.

Embodiments according to the present disclosure are not limited to the above-described embodiment. The orientation in which the transformer 1 is placed is not limited to the above-described example. FIG. 7 is a drawing illustrating another example of placement of the transformer according to the embodiment. The transformer 1 may be placed such that the first surface 11*a* and the second surface 11*b* of the base 11 are orthogonal to the vertical direction. The same applies to the transformers 2, 3 and 4. The power conversion device 30 including the transformer 1 illustrated in FIG. 7 includes the open section 33 located in the vertically upper portion and the closed section 34 located in the vertically lower portion. The transformer 1 may be inserted into the interior of the power conversion device 30 from the inspection port formed in the vertically lower surface of the housing 31 of the power conversion device 30. The shapes of the cores 12 and 25 are not limited to those of the above-described examples. The number of coils 13 is freely selected as two or more. Additionally, the method of winding the coil 13 around the cores 12 and 25 is not limited to the above-mentioned examples.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

REFERENCE SIGNS LIST

1, 2, 3, 4 Transformer
11 Base
11*a* First surface
11*b* Second surface
11*c* Third surface
12, 25 Core
13 Coil
14 Coil terminal
15 Fixing frame
16, 21, 22, 28 Cooling unit
16*a*, 24, 28*a* Fin
17 Insulating member
18 Slide portion
19 Handle
20 Locking member
20*a* Locking hole
23 Heat pipe
26 End portion
27 Leg
30 Power conversion device
31 Housing
32 Partition
33 Open section
34 Closed section
35 Opening
36 Vent
37 Blower
38 Electronic circuit
39 Conductor

The invention claimed is:

1. A transformer comprising:

a base that is a plate-like member and has a first surface and a second surface;

a core attached to the first surface of the base;

coils wound around the core;

coil terminals that are each electrically connected to one end of a corresponding coil of the coils and are disposed on the second surface opposite to the first surface of the base to which the core is attached; and a fixing frame disposed on a side of the core opposite to the base, the core being fixed to the fixing frame, wherein the first surface of the base extends in a vertical direction, and the fixing frame is a plate-like member extending in the vertical direction and includes a slide portion that (i) extends away from the base at a vertically lower end of the fixing frame and (ii) has an edge located at a position, in the vertical direction, higher than a position of the vertically lower end of the fixing frame, the slide portion having a slide surface for facilitating movement of the transformer.

2. The transformer according to claim 1 further comprising:

a cooling unit that is disposed on a side of the core opposite to the base, is thermally connected to the core, and is to release heat transferred from the core.

3. The transformer according to claim 2, wherein the cooling unit is attached to the fixing frame and is to release heat transferred from the cores via the fixing frame.

4. The transformer according to claim 3, wherein the core is a plurality of cores, and the cooling unit releases heat transferred from the cores via the fixing frame.

5. The transformer according to claim 4, wherein the cooling unit has a fin-like shape.

6. The transformer according to claim 4, wherein the cooling unit has a lattice-like shape.

7. The transformer according to claim 4, wherein the cooling unit comprises a heat pipe in which refrigerant is enclosed.

8. The transformer according to claim 3, wherein the cooling unit has a fin-like shape.

9. The transformer according to claim 3, wherein the cooling unit has a lattice-like shape.

10. The transformer according to claim 3, wherein the cooling unit comprises a heat pipe in which refrigerant is enclosed.

11. A power conversion device comprising:

the transformer according to claim 3;

an electronic circuit electrically connected to the coil terminals; and a housing to accommodate the transformer and the electronic circuit, wherein an interior of the housing is divided by a partition into (i) an open section through which an ambient air flow passes and (ii) a closed section through which an ambient air flow does not pass, the partition has an opening, the electronic circuit is accommodated in the closed section, the transformer is accommodated in the housing such that (i) the core, the coils, and the cooling unit are located in the open section and (ii) the coil terminals are located in the closed section, and the base of the transformer covers the opening of the partition.

12. The transformer according to claim 2, wherein the cooling unit has a fin-like shape.

13. The transformer according to claim 2, wherein the cooling unit has a lattice-like shape.

14. The transformer according to claim 2, wherein the cooling unit comprises a heat pipe in which refrigerant is enclosed.

15. A power conversion device comprising:

the transformer according to claim 2;

an electronic circuit electrically connected to the coil terminals; and a housing to accommodate the transformer and the electronic circuit, wherein an interior of the housing is divided by a partition into (i) an open section through which an ambient air flow passes and (ii) a closed section through which an ambient air flow does not pass, the partition has an opening, the electronic circuit is accommodated in the closed section, the transformer is accommodated in the housing such that (i) the core, the coils, and the cooling unit are located in the open section and (ii) the coil terminals are located in the closed section, and the base of the transformer covers the opening of the partition.

16. A power conversion device comprising:

the transformer according to claim 1;

an electronic circuit electrically connected to the coil terminals; and a housing to accommodate the transformer and the electronic circuit, wherein an interior of the housing is divided by a partition into (i) an open section through which an ambient air flow passes and (ii) a closed section through which an ambient air flow does not pass, the partition has an opening, the electronic circuit is accommodated in the closed section, the transformer is accommodated in the housing such that (i) the core and the coils are located in the open section and (ii) the coil terminals are located in the closed section, and the base of the transformer covers the opening of the partition.

* * * * *